United States Patent [19]

Heselton et al.

[11] Patent Number: 4,852,883

[45] Date of Patent: Aug. 1, 1989

[54] APPARATUS FOR PRACTISING GOLF STROKE

[76] Inventors: John Heselton, 680 NW. 24th St., Faribault, Minn. 55021; Perry Nelson, 13033 N. 8th Ave., Phoenix, Ariz. 85029; Tod Aldrich, 201 Main St., Westcliffe, Colo. 81252

[21] Appl. No.: 162,613

[22] Filed: Mar. 1, 1988

Related U.S. Application Data

[63] Continuation-in-part of Ser. No. 908,231, Sep. 17, 1986, abandoned.

[51] Int. Cl.[4] ..... A63B 69/36

[52] U.S. Cl. ..... 273/197 R; 273/200 B

[58] Field of Search ..... 273/200 R, 200 B, 197 R, 273/197 A, 184 B, 185 D, 184 R, 185 R

[56] References Cited

U.S. PATENT DOCUMENTS

| | | | |
|---|---|---|---|
| 1,976,405 | 10/1934 | Le Witt | 273/200 B |
| 3,643,961 | 2/1972 | Schroeder | 273/200 R |
| 4,407,503 | 10/1983 | Nishizawa | 273/197 R |

FOREIGN PATENT DOCUMENTS

| | | | |
|---|---|---|---|
| 725556 | 2/1932 | France | 273/200 B |
| 20247 | of 1906 | United Kingdom | 273/200 B |

*Primary Examiner*—George J. Marlo

*Attorney, Agent, or Firm*—Tod R. Nissle

[57] ABSTRACT

Improved golf practising apparatus. The apparatus includes a golf ball replica carried by the apparatus such that the replica can be struck by the head of the golf club when a golfer swings the club. When the golf ball replica is struck by a golf club, the replica rotates about a pivot point and tends to come to a halt in a position generally corresponding to the position in which the replica was struck by the golf club. A golf ball simulating member is formed at the end of an arm integrally connected to a counterweight in the shape of a disc which revolves about a pivot point when the golf ball member is hit with a golf club. The center of gravity of the combined golf ball member and arm is located at a distance from the pivot point which is greater than the distance from the pivot point to the center of gravity of the disc. The resiliency of the arm is such that, in its stationary position, the golf ball drops down, and rests on a supporting surface, and when the ball member is struck by a golf club, the arm bends and the golf ball member impacts the peripheral edge of the disk before the disk moves any appreciable distance.

4 Claims, 2 Drawing Sheets

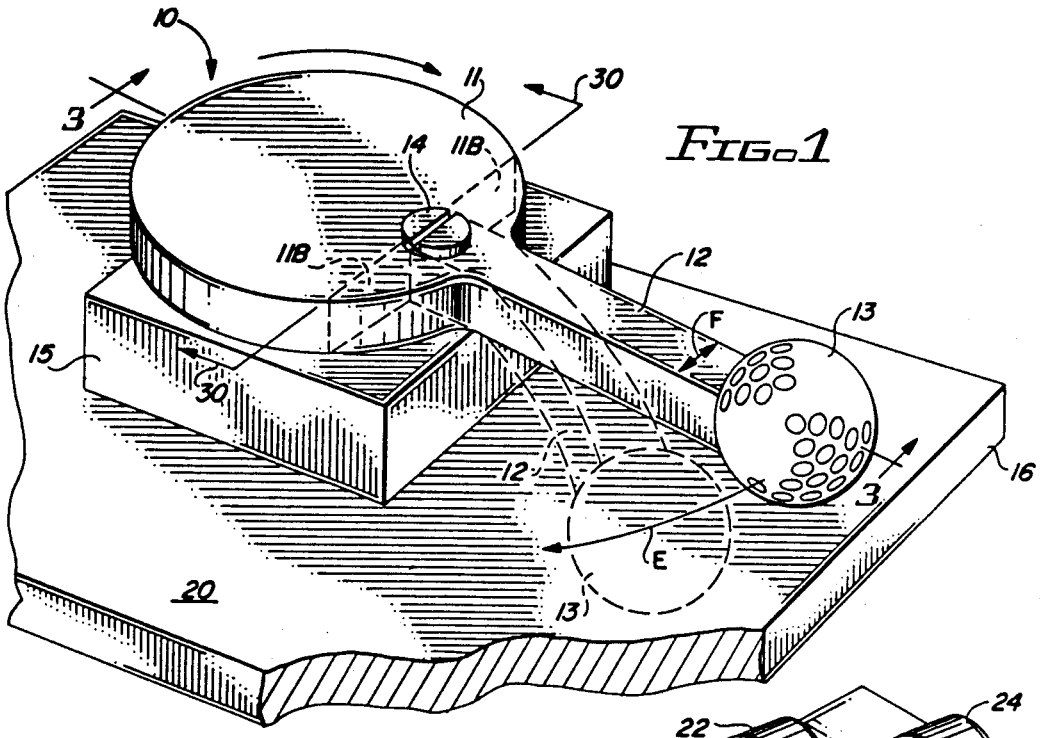
FIG. 1
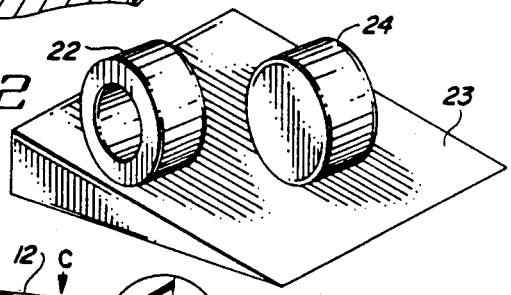
FIG. 2
FIG. 3
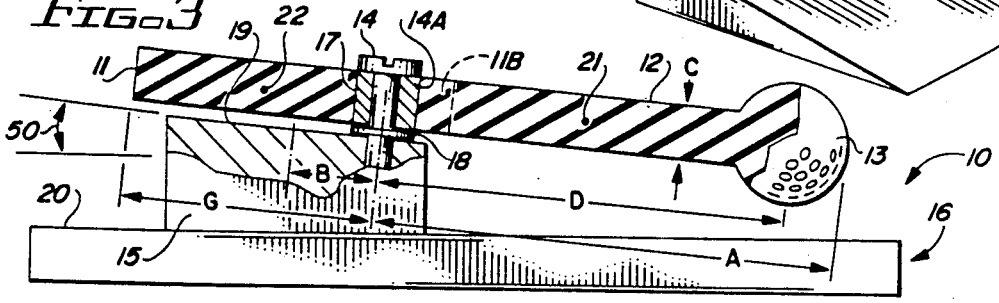
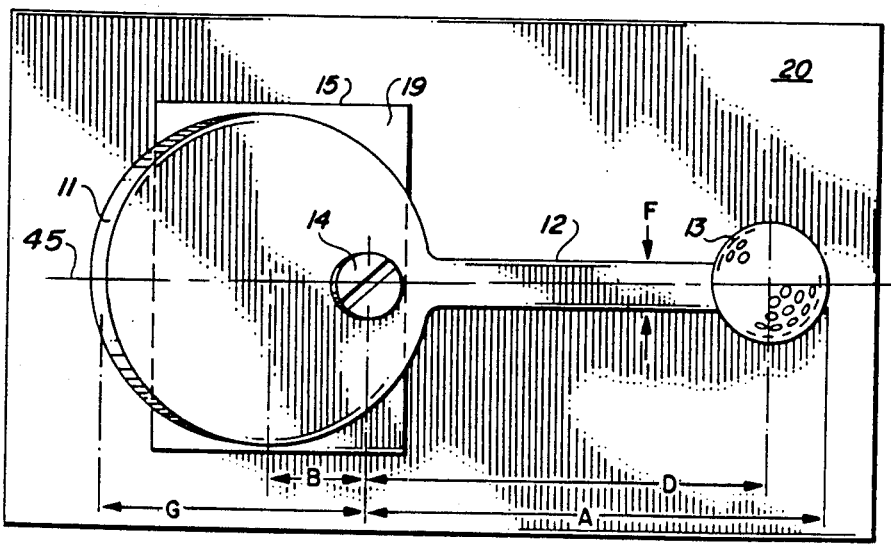
FIG. 4

APPARATUS FOR PRACTISING GOLF STROKE

This application is a continuation-in-part of Ser. No. 06/908,231, filed Sept. 17, 1986, now abandoned.

This invention pertains to apparatus for practising a golf stroke.

More particularly, the invention relates to a unitary unbalanced golf practising apparatus which includes a captive golf ball replica carried by the apparatus such that the replica can be struck by the head of a golf club when a golfer swings the club, the golf ball replica rotating about a pivot point and tending to come to a halt in a position generally corresponding to the position in which the replica was struck by the head of the golf club.

In a further respect, the invention relates the an unbalanced golf practising apparatus of the type described in which a golf ball replica is attached to an elongate resilient arm connected to and extending from a counterweight rotatably mounted on a pivot, the counterweight and arm being shaped and dimensioned such that when the golf ball replica is struck by the head of the golf club, the arm initially resiliently bends to absorb a portion of the force of the blow prior to rotation of the counterweight about the pivot.

In another respect, the invention relates to an unbalanced golf practising apparatus in which a golf ball replica is attached to an elongate resilient arm connected to and extending from a rotatably mounted counterweight the golf ball replica and resilient arm absorbing and damping vibrations generated when the head of the golf club contacts the golf ball replica.

Golf practising apparatus are well known in the art. See, for example, U.S. Pat. Nos. 1,808,390 to Volk, 2,207,661 to Johanson, 2,888,266 to Melin, 2,911,221 to Butler, and 3,642,961 to Schroeder. Such devices typically comprise an elongate arm which has a golf ball or golf ball replica attached to one end of the arm. The arm is pivotally mounted at the other end of the arm or at a point at the center of the arm. When the arm is pivotally mounted at a point at the center of arm, the portions of the arm extending to either side of the pivot point counterbalance one another.

In use, prior art golf practise device of the type described have certain practical drawbacks. When a golfer utilizes a club to strike the golf ball replica mounted on a prior art device, the replica tends, after rotating about the pivot point, to come to rest in a position different from the operative position of the replica when the replica was struck by the golf club. Consequently, after the replica comes to rest it must usually be moved by the golfer to its operative position so the replica can again be struck with a golf club. Another drawback of prior art golf practising devices is that they are often carefully balanced and the only forces tending to stop rotation of the devices after they are struck by a golf club are the frictional forces generated at the pivot point of the device and generated by air flowing over the surfaces of the device. As a result, the golf ball replica can rotate for a relatively long time before stopping. One method utilized to reduce the length of time the replica rotates is to mount the replica on a relatively short pivot arm. However, when the replica is on a short pivot arm, it quickly turns away from a straight line of travel, and when a golfer strikes the replica with a club, the sensation created in the golfer's hands is not comparable to the sensation created when the golf strikes a real golf ball mounted on a tee. Still another method utilized to reduce the length of time a golf ball replica rotates about a pivot point after the replica is struck is to make the replica hollow or lightweight. A lightweight replica also does not produce in the golfer's hands a sensation similar to that produced when the golfer strikes a real golf ball. It is important to a golfer that a golf practise device duplicate the "feel" or sensation produced during the striking of an ordinary golf ball.

Accordingly, it would be highly desirable to provide a golf practise device in which a golf ball replica was attached to a pivotally mounted arm which would tend to return to and stop in a desired position after the replica was struck by the head of a golf club and after the arm rotated about its pivot point.

It would also be highly desirable to provide golf practise apparatus which would accurately simulate the sensations generated in a golfer's hands when he strikes an ordinary golf ball, and which would relatively rapidly absorb and dissipate the forces generated when the golf ball replica is struck by the head of the golf club.

Therefore, it is a principal object of the invention to provide an improved golf practise apparatus.

Another object of the invention is to provide improved golf practise apparatus of the type including a golf ball replica secured to one end of a pivotally mounted support arm, the golf ball replica and support arm having a normal operative position in which the replica is struck by the head of a golf club.

A further object of the instant invention is to provide improved golf practise apparatus of the type described in which the golf ball replica tends to return to and stop at its normal operative position after being contacted by the head of a golf club and after rotating about the pivot point of the support arm.

Still another object of the invention is to provide improved golf practise apparatus of the type described in which a weight attached to one end of the support arm carrying the golf ball replica partially counterbalances the replica and has a moment of inertia which functions as an anchor and dissipate the force imparted to the replica by the head of a golf club.

Yet another object of the invention is to provide improved golf practise apparatus of the type described which enables the hands of a golfer to readily sense when the head of a golf club squarely strikes the golf ball replica.

These and other, and further and more specific objects and advantages of the invention will be apparent to those skilled in the art from the following detailed description thereof, taken in conjunction with the drawings, in which:

FIG. 1 is a perspective view illustrating golf practicing apparatus constructed in accordance with the principles of the invention;

FIG. 2 is a perspective view illustrating the differing moments of inertia of a ring and solid cylinder rolling down an incline;

FIG. 3 is a side view of the golf practising apparatus of FIG. 2 illustrating the golf ball replica in the position where it is closest to the upper surface of the base of the apparatus.

FIG. 4 is a top view of FIG. 1; and

Figure 5:
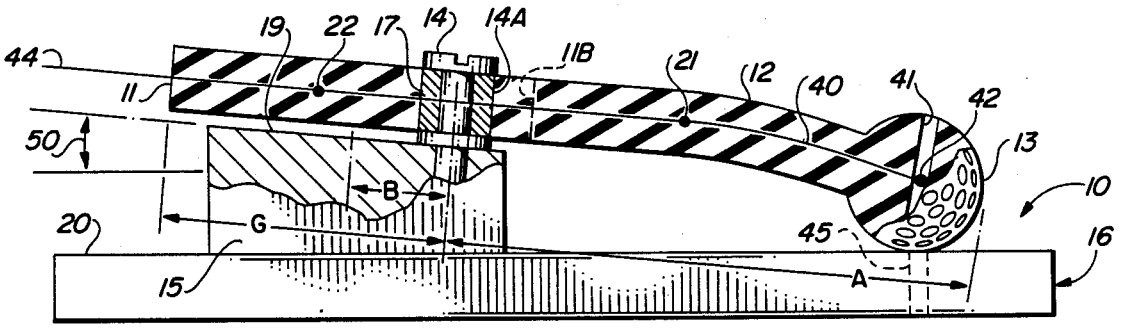
Figure 6:
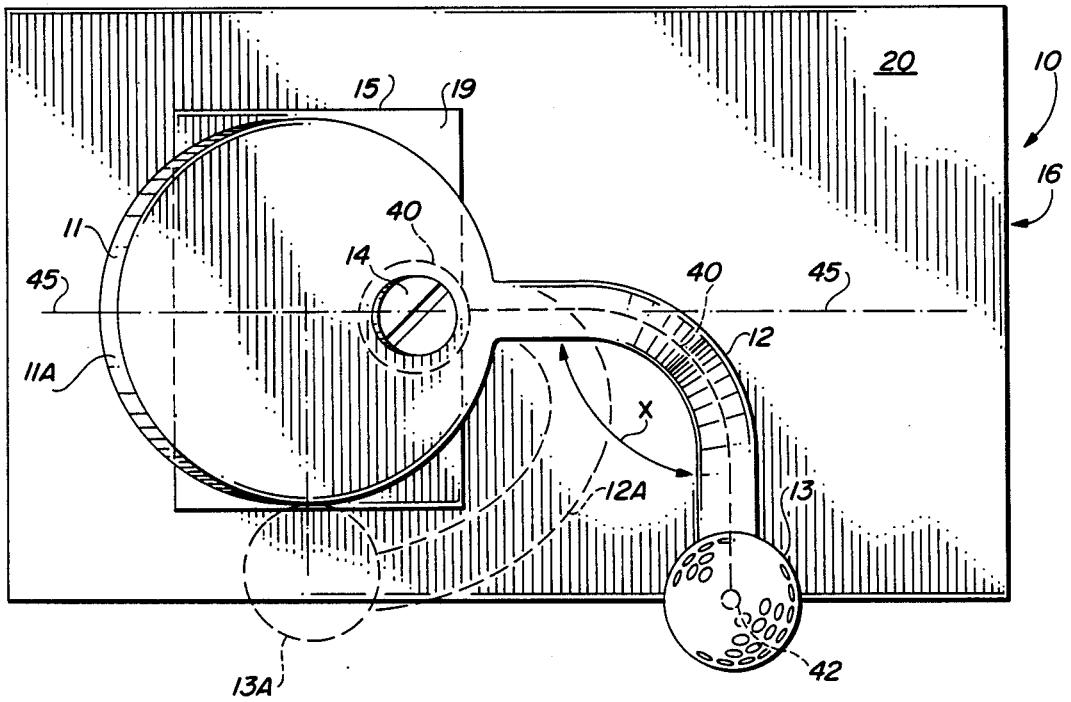

FIGS. 5 and 6, respectively, show side and top views of an alternate embodiment of the invention.

Briefly, in accordance with the presently preferred embodiment of our invention, we provide improved golf practising apparatus. The apparatus includes a base; an elongate arm having a first end and a second end, the second end being attached to a pivot point on said base such that the arm moves in a reference plane when the arm rotates about the pivot point, the reference plane being sloped with respect to a horizontal plane; golf ball means attached to the first end of the elongate arm; and, a counterweight attached the second end of the elongate arm and generally moving in the reference plane when the counterweight and elongate arm rotate about the pivot point. The moment of inertia of the elongate arm and golf ball means is greater than the moment of inertia of the counterweight. The force of gravity acting on the golf ball means and elongate arm is greater than the force of gravity acting on the counterweight such that the center of gravity of the golf ball means and elongate arm is at a distance from the pivot point which is greater than the distance from the pivot point to the center of gravity of the counterweight.

Turning now to the drawings, which depict the presently preferred embodiments and best mode of the invention for the purpose of illustrating the practise thereof and not by way of limitation of the scope of the invention and in which like reference characters identify corresponding elements throughout the several views, FIGS. 1, 3 and 4 illustrate golf practise apparatus constructed in accordance with the principles of the invention and including a unitary member generally indicated by reference character 10 and pivotally mounted on stand 15 with bolt 14. The unitary member 10 includes golf ball replica 13 attached to elongate arm 12. Arm 12 is connected to disk 11. Bushing 14A is force fit in aperture 17 extending through disk 11. Washer 18 is interposed between disk 11 and upper sloped surface 19 of stand 15. Stand 15 is attached to base 16. Golf ball replica 13, arm 12 and disk 11 are presently preferably solid and formed from rubber of the type comprising hockey pucks. In the presently preferred embodiment of the invention, the diameter of disk 11 is 4.50 inches; the width, indicated by arrows F in FIG. 1, of arm 12 is 0.625 inches; the thickness, indicated by arrow C in FIG. 3, of disk 11 and arm 12 is 0.625 inches; the diameter of golf ball replica 13 is 1.6875 inches; the distance, indicated by arrow D in FIG. 3, from the center of bolt 14 to the center of golf ball replica 13 is 5.250 inches; and, the distance, indicated by arrow B in FIG. 3, from the center of bolt 14 to the center point of disk 11 is 1.625 inches.

When golf ball replica 13 is struck with the head of golf club, replica 13, arm 12 and disk 11 rotate about the pivot point defined by bolt 14. When replica 13 rotates about bolt 14, the distance of replica 13 above the horizontal upper surface 20 of base 16 varies. In FIG. 3, replica 13 is shown in the position in which replica 13 is closest to surface 20. When unitary member 10 of the apparatus of the invention is in the position illustrated in FIG. 3, the mass of the portion of the unitary member 10 to the left of the center point of bolt 14 in FIG. 3, i.e., the mass of the portion of the unitary member in the area designated by arrow G, is equal to the mass of the portion of the unitary member to the right of the center point of bolt 14 in FIG. 3. In FIG. 3 the portion of unitary member 10 to the right of the center point of bolt 14 is indicated by arrow A and generally includes golf ball replica 13, arm 12, and portions 11B of disk 11. In FIG. 3 the portion of unitary member 10 to the left of the center point of bolt 14 generally includes most of disk 11.

Even though the mass of unitary member 10 on either side of bolt 14 is, in the presently preferred embodiment of the invention, generally equivalent, the force of gravity produces a greater downward force on the golf ball replica 13 and elongate arm 12 extending to one side of bolt 14 than it produces on the portion of disk 11 extending from bolt 14 and away from replica 13 and arm 12. Consequenty, the center of gravity 21 of the replica 13—elongate arm 12 portion of unitary member 10 is at a greater distance from bolt 14 than the center of gravity 22 of the portion of disk 11 extending from bolt 14 and away from replica 13 and elongate arm 12.

In FIG. 1, the portion of disk 11 extending from bolt 14 and away from replica 13 and arm 12 is indicated by arrows 30 and does not include portions 11B of disk 11.

The position of unitary member 10 shown in FIG. 3 is the position occupied by member 10 prior to a golfer's swinging a club to strike replica 13 with the head of the club. After replica is contacted by the head of a club, replica 13, arm 12 and disk 11 rotate about bolt 14. Since the center of gravity 21 of replica 13, arm 12 and disk portions 11B is further from bolt 14 than the center of gravity 22 of the portion of disk 11 extending from bolt 14 and away from arm 12, and, since unitary member 10 is sloped, replica 13 tends to return to and stop at the position of FIG. 3 after being contacted by the head of a golf club and rotating about bolt 14.

The rotational inertia $I_D$ of a solid disk about a "primary" axis passing through the center of and perpendicular to the planar faces of the disk is:

$$I_D = 1.5MR^2$$

M = the mass of the disk and R = the radius of the disk. The rotational inertia $I_{DB}$ of a solid disk about an "secondary" axis which is parallel to and at a distance B from the primary axis is $$I_{DB} = I_C + MB^2$$

The rotational inertia $I_S$ of a solid sphere or a particle attached to a line or string and rotating about a point is $$I_S = MR^2$$

M = the mass of the particle of sphere and R = the distance of the center of the particle from the point about which the particle is rotating.

The rotational inertia $I_R$ of a thin rod having one end attached to an axis about which the rod rotates is $$I_R = 0.3333ML^2$$

M = the mass of the rod and L = the length of the rod.

Accordingly, the rotational inertias of the disk 11, arm 12, and replica 13 can be approximated as follows. The mass of disk 11 is assumed to be 1 pound. The moment of inertia of the disk 11 is:

$$\begin{aligned} I_{DB} &= 1.5(1\text{ lb.})(2.25\text{ in})^2 + (1\text{ lb.})(1.625)^2 \\ &= 5.17\text{ lb-in}^2 \end{aligned}$$

The approximate moment of inertia of arm 12 is:

$$\begin{aligned} I_R &= 0.3333(0.5\text{ lb})(4.41\text{ in})^2 \\ &= 1.30\text{ lb-in}^2 \end{aligned}$$

The approximate moment of inertia of replica 13 is:

$$I_p = 0.5 \text{ lb } (5.250)^2$$
$$= 13.78 \text{ lb-in}^2$$

The approximate moment of inertia of the replica 13 and arm 12 is therefore equal to 15.08 lb-in$^2$ and is substantially greater than the moment of inertia, $I_{DB}$, of disk 11.

As illustrated in FIG. 2, a ring 22 rolls down an incline 23 more slowly than a solid cylinder 24, whether or not they have they have the same mass or outer diameter. A ring has greater rotational inertia compared to its weight. This doesn't seem plausible at first thought, but any two objects, regardless of mass, will fall together when dropped. They will also slide together when released on an inclined plane. But when rotation is introduced, the object with the larger rotational inertia compared to its own weight more greatly resists a change in its motion. Hence any disk will roll faster than any ring on the same incline. If ring 22 were attached to cylinder 24, ring 22 would slow the movement cylinder 24 down incline 23. In the golf practice device of the invention, the disk, even though it has a mass generally equivalent to that of the arm 12 and replica 13, has a rotational inertia which is less than that of the arm 12 and replica 13. Consequently, during rotation of unitary member 10, disk 11 tends to slow or brake a change in the position or movement of replica 13 and arm 12. The greater rotational inertia of disk 11 and the unbalanced centers of gravity 21 and 22 function to slow the speed of rotation of unitary member 10 after replica 13 is struck by the head of a golf club.

The mode of operation of the apparatus of the invention is illustrated in FIG. 2. When replica 13 is contacted by the head of a golf club, replica 13 is displaced in the direction of arrow E, causing arm 12 to initially bend in the manner indicated by the dashed ghost outline of arm 12 and replica 13 in FIG. 1. The bending of arm 12 facilitates the rapid departure of replica 13 from the face of the golf club and absorbs a substantial portion of the force imparted to the replica. Disk 11 initially opposes the rotation of arm 12. The rubber substance utilized to fabricate unitary member 10 absorbs vibrations which occur when the club head contacts the material, causing the magnitude of vibrations transmitted through the club to sensory nerves in a golfer's hands to be minimized. Consequently, the sensations produced in the golfer's hands when the club strikes the replica indicate that the club head had squarely contacted a real golf ball. These same damping qualities facilitate use of the rubber material in hockey pucks.

The ability of member 10 to absorb vibrations increases as the mass of member 10 increases.

The bending of arm 12 which occurs when replica 13 is contacted with the head of a golf club facilitates slowing of the unitary member 10, because when replica 13 is initially struck, replica 13 moves, then arm 12, and then disk 11. This whipping non-uniform motion of arm 12 with respect to disk 11 absorbs energy and further reduces the rate at which disk 11 and arm 12 rotate about bolt 14.

If the mass of disk 11 is too great with respect to the mass of replica 13 and arm 12, then member 10 will not rotate or will not rotate quickly enough when struck by a golf club. The ratio of the moment of inertia of replica 13 and arm 12 to the moment of inertia of disk 11 is presently preferably in the range of 10:1 to 2:1.

The slope of member 10 with respect to the horizontal upper surface 20 of base 16 is indicated by arrows 50 in FIG. 3 and is presently preferably in the range of 3° to 30°.

In the alternate embodiment of the invention shown in FIGS. 5 and 6, arm 12 is fabricated from a resilient material such that arm 12 downwardly bends or droops to permit replica 13 to rest on surface 20. In FIG. 5, arm 12 downwardly droops from the sloped plane 44 bisecting disk 11 and from the upper end of arm 12 attached to disk 11. After the replica 13 of FIG. 5 is struck by the head of a golf club, the centrifugal force imparted to replica 13 by the clubhead causes arm to straighten to the orientation shown in FIGS. 1 to 3, i.e. the force acting on replica 13 as it rotates about bolt 14 straightens arm 12. The droop or arcuate shape taken on by arm 12 in FIG. 5 is advantageous because an iron or "lofted" club is used to strike replica 13 while it rests on surface 20. Aperture 45 in base 16 receives a golf tee which supports replica 13 above surface 20 to enable replica 13 to be struck with a driver or wood club.

The ratio of the moment of inertia of replica 13 and arm 12 to the moment of inertia of disk 11 is, as earlier noted, presently preferably in the range of 10:1 to 2:1. This means, of course, that the ratio can be 9:1, 8:1, 7:1 etc., can be in the range of 9:1 to 3:1, of 4:1 to 2:1, etc. In other words the ratio can, as would be appreciated by those of skill in the art, be in the range of 10:1 to 2:1 or in any range contained within said range.

The apparatus of the invention is constructed such that when replica 13 is solidly struck with a driver, replica 13 moves from the position shown in FIG. 4 to the position illustrated in FIG. 6. In FIG. 6 replica 13 and the end of arm 12 adjacent replica 13 are perpendicular or at 90° (angle X) to the end of arm 12 attached to disk 12 and to horizontal axis 45 passing therethrough. The movement of replica 13 from the position shown in FIG. 4 to the position shown in FIG. 6 takes place before disk 11 moves any appreciable distance. The moment of inertia of disk 11 stabilizes disk 11 and minimizes any movement thereof immediately after replica 13 is impacted by a golf club.

When replica 13 is well hit with a golf club, replica 13 and arm 12 will actually move to the position illustrated in FIG. 6 by dashed lines 13A and 12A. Ball 13 contacts the cylindrical outer peripheral edge surface 11A of disk 11. In this position the angle X between the end of arm 12 adjacent replica 13 and the end of arm 12 adjacent disk 11 has become zero or nearly zero, i.e., the ends of arm 12 are parallel. This significant bending of arm 12 after replica 13 is contacted by a golf club indicates the importance of the weight of disk 11 with respect to replica 13 and arm 12, of the shape of disk 11 (to halt the bending of arm 12), and of the ratio of the moment of inertia of the arm 12 and replica 13 to disk 11. The ratio of the moment of inertia of replica 13 and arm 12 to the moment of inertia of disk 11, while being in the range of 10:1 to 2:1, is typically 4:1 to 2:1. Edge surface 11A extends from one side of arm 12 around disk 11 and bolt 14 to the other side of arm 12. When disk 11, arm 12 and replica 13 are rotating about bolt 14, the disk 11, arm 12 and replica 13 all generally lie in a common flat plane 44. Axis 45 lies in plane 44.

A safety wire, string, or other elongate structural member 40 is imbedded in disk 11, arm 12, and replica 13 in the manner illustrated in FIGS. 5 and 6. If replica 13 breaks away from arm 12 or if arm 12 breaks away from disk 11, then member 40 prevents replica 13 or arm 12 from flying away from the apparatus of the invention and possibly injuring an individual standing nearby. Member 40 loops around bolt 14 and is anchored in replica 13. In FIGS. 5 and 6, member 40 has been anchored by tying a knot 42 in the string or strand comprising member 40.

With respect to the bending of arm 12 in the manner illustrated in FIG. 6, it is noted that the device shown in U.S. Pat. Nos. 4,407,503 to Nishizawa does not appear to disclose such a feature. The Nishizawa device does not include the proper combination of resilient material and of moments of inertia of the golf ball and arm and the counterweight. Nishizawa does not use a counterweight. One half of sleeve support 8 is equal in weight to the other half of sleeve 8 but is not equal to the combined weight of ball 6, arm 7, and the remaining half of sleeve 8. Sleeve 8 does not function as a counterweight for arm 7 and ball 6. Arm 7 is Nishizawa and the sleeve to which arm 7 is attached must rotate at the same or nearly the same velocity from the moment of the impact of ball 6. Nishizawa does not utilize a resilient arm. Ball 7 does not contact the sleeve rotating about arm 5.

Having described our invention in such terms as to enable those skilled in the art to understand and practice it, and having identified the presently preferred embodiments thereof, we claim:

1. Golf practising apparatus including (a) a base having a generally horizontal upper surface;

(b) a resilient elongate arm having a first and a second end, said second end being attached to a fixed pivot point connected to and positioned above said base such that said arm moves in a fixed flat reference plane when said arm rotates about said pivot point, said plane being sloped with respect to said horizontal upper surface;

(c) golf ball means attached to said first end of said elongate arm and moving above said base in said reference plane with said arm when said arm rotates about said pivot point;

(d) a counterweight attached to said second end of said elongate arm and (i) moving in said reference plane above said base when said counterweight rotates about said pivot point with said arm, (ii) resting in said reference plane above said base when stationary, (iii) having a mass generally equal to the combined mass of said elongate arm and golf means, and, (iv) having a peripheral edge;

the moment of inertia of said elongate arm and golf ball means with respect to the moment of inertia of said counterweight being in the range of 4:1 to 2:1;

the force of gravity acting on said golf ball means and elongate arm being generally equivalent to the force of gravity acting on said counterweight;

the torque produced by said force of gravity on said counterweight being less than the sum of the torque produced by the force of gravity on said golf ball means and said elongate arm;

the center of gravity of said golf ball means and elongate arm being at a distance from said pivot point which is greater than the distance from said pivot point to the center of gravity of said counterweight; and, (e) said elongate arm having at least two operative positions, (i) a first operative position in which said arm, counterweight and golf ball means are stationary, and (ii) a second operative position immediately after said golf ball means is struck by the head of a golf club, said first end of said elongate arm being at an angle to said second end of said arm which is ninety degrees or less, said golf ball means contacting said peripheral edge in said second operative position when said golf ball means is contacted by the head of a wood golf club moving at a selected speed of travel.

2. Golf practicing apparatus including (a) a base having a generally horizontal upper surface;

(b) a resilient elongate arm having a first and a second end, said second end being attached to a fixed pivot point connected to and positioned above said base such that said arm freely moves in a fixed flat reference plane when said arm rotates about said pivot point at a selected speed, said plane being sloped with respect to said horizontal upper surface;

(c) golf ball means attached to said first end of said elongate arm and moving above said base in said reference plane with said arm when said arm rotates about said pivot point;

(d) a counterweight attached to said second end of said elongate arm and (i) moving in said reference plane above said base when said counterweight rotates about said pivot point with said arm, (ii) resting in said reference plane above said base when stationary, (iii) having a mass generally equal to the combined mass of said elongate arm and golf means, and, (iv) having a peripheral edge;

the moment of inertia of said elongate arm and golf ball means with respect to the moment of inertia of said counterweight being in the range of 4:1 to 2:1;

the force of gravity acting on said golf ball means and elongate arm being generally equivalent to the force of gravity acting on said counterweight;

the torque produced by said force of gravity on said counterweight being less than the sum of the torque produced by the force of gravity on said golf ball means and said elongate arm;

the center of gravity of said golf ball means and elongate arm being at a distance from said pivot point which is greater than the distance from said pivot point to the center of gravity of said counterweight and, (e) said elongate arm having at least two operative positions, (i) a first operative position in which said arm, counterweight and golf ball means are stationary, and said elongate arm is resiliently bent downwardly to permit said golf ball means to rest on said base, and (ii) a second operative position immediately after said golf ball means is struck by the head of a golf club, said first end of said elongate arm being in said reference plane and at an angle to said second end of said arm which is ninety degrees or less.

3. Golf practicing apparatus including (a) a base having a generally horizontal upper surface;

(b) a resilient elongate arm having a first and a second end, said second end being attached to a fixed pivot point connected to and positioned above said base such that said arm freely moves in a fixed flat reference plane when said arm rotates about said pivot point, said plane being sloped with with respect to said horizontal upper surface;

(c) golf ball means attached to said first end of said elongate arm and moving above said base in said reference plane with said arm when said arm rotates about said pivot point;

(d) a counterweight attached to said second end of said elongate arm and (i) moving above said base when said counterweight rotates about said pivot point with said arm, (ii) having a peripheral edge, and, (e) an elongate structural member extending from said counterweight through said arm to said golf ball means to interconnect said counterweight, arm and golf ball means in the event one of said counterweight, arm and golf ball means is broken apart from the other during utilization of said practising apparatus.

4. The golf practicing apparatus of claim 3 wherein said elongate arm has at least two operative positions, (a) first operative position in which said arm, counterweight and golf ball means are stationary; and, (b) a second bent operative position immediately after said golf ball means is struck by the head of a golf club, said first end of said elongate arm being at an angle of ninety degrees or less, to said second end of said arm, said golf ball means contacting said peripheral edge in said second operative position when said golf ball means is contacted by the head of a wood driving golf club moving at a selected speed of travel.

* * * * *